US005371719A

United States Patent [19]

Burn et al.

[11] Patent Number: 5,371,719

[45] Date of Patent: Dec. 6, 1994

[54] HIGH SECURITY ULTRASONIC RECEIVER APPARATUS

[75] Inventors: James W. Burn, Sunnyvale; Charles T. Stone, Felton; Kevin M. Wood, Campbell, all of Calif.

[73] Assignee: Sentry Products, Inc., Santa Clara, Calif.

[21] Appl. No.: 888,541

[22] Filed: May 22, 1992

[51] Int. Cl.[5] ..... G08B 13/00

[52] U.S. Cl. ..... 367/173; 340/566; 181/0.5

[58] Field of Search ..... 367/140, 165, 173; 340/566; 181/0.5, 150, 400

[56] References Cited

U.S. PATENT DOCUMENTS 3,618,062 11/1971 Ott ..... 340/566

4,649,754 3/1987 Zacharias ..... 310/334

*Primary Examiner*—J. Woodrow Eldred

*Attorney, Agent, or Firm*—Claude A. S. Hamrick

[57] ABSTRACT

A high security ultrasonic receiver apparatus including a rigid metal faceplate having an ultrasonic sensor affixed to the rear side thereof and adapted to sense acoustical energy transmitted to the faceplate. The faceplate has no apertures through which acoustical energy is intended to be communicated to the transducer. All acoustical energy is mechanically coupled to the transducer. The plate is further adapted to be affixed to a wall or wall receptacle in a manner similar to that of a standard electrical switchplate or plug socketplate. The transducer and associated electronic components are adapted to be electrically connected to a remote annunciator in a conventional manner.

16 Claims, 2 Drawing Sheets

HIGH SECURITY ULTRASONIC RECEIVER APPARATUS

BACKGROUND OF THE INVENTION

1. Field of the Invention

The present invention relates generally to ultrasonic receiver apparatus, and more particularly to an ultrasonic receiver configured to be vandal-resistant in that it includes tamper-resistant fasteners, is a sturdy faceplate able to withstand repeated blows from any object potentially available to an inmate in a correctional or psychiatric facility, and has no unclosed passageways through which liquid or foreign objects may be passed.

2. Discussion of the Prior Art

Heretofore, ultrasonic transmitter/receiver apparatus has been used in duress alarm systems in settings such as hospitals, jails, courtrooms, warehouses, etc. to provide remote indication of an emergency situation. In such systems, a remote transmitter of an acoustical signal, typically in the form of a pen-like source or a small transmitter attached to the clothing of a person at risk, is used to generate an initiating ultrasonic distress signal which is then detected by a conventional ultrasonic receiver having a transducer mounted flush with the faceplate of the receiver or disposed behind perforations in the faceplate. Such positioning of the transducer allows the pressure wave generated by the source to impinge directly on the transducer and provide optimum sensitivity to the ultrasonic signal. However, the use of such a receiver in hostile environments exposes the transducer to damage by beating, poking or the injection of liquids that can destroy the unit or at the least inhibit its performance. Thus, historically, duress alarm systems have not been installed in patient rooms or cells because of the high maintenance cost and the lack of system reliability due to false alarms and malfunction.

In devices which operate in the audio spectrum, this problem has previously been addressed by building baffles and other complex geometric designs to provide physical barriers between the faceplate and the transducer. However, this results in a relatively expensive product. While it is clear that such an approach could work for applications using typical ultrasonic frequencies (namely, frequencies on the order of 43 KHz), it is not known that such an approach has been tried. As an alternative, attempts have been made to simply prevent access to the receiver. This either increases the cost of the installation or decreases the range or sensitivity of the receiver.

There is thus a need for a receiver that can be located in the room, cell or other environment of a secure facility where the clients, inmates, or prisoners have both time and opportunity to vandalize the unit.

SUMMARY OF THE INVENTION

It is therefore a principal object of the present invention to provide an ultrasonic receiver which is rugged enough to be mounted in the wall or ceiling of an enclosure containing hostile inhabitants.

Another objective of the present invention is to provide a receiver of the type described which cannot readily be damaged by tampering or contact with implements of the type normally available to an inhabitant of the enclosure.

Still another objective of the present invention is to provide a device of the type described which is substantially immune to damage as a result of being subjected to sputum or urine.

Yet another objection of the present invention is to provide a device of the type described which can be mounted to a wall or ceiling in substantially the same way that a typical electrical wall outlet or switch is attached.

Briefly, a preferred embodiment of the present invention includes a rigid metal faceplate having an ultrasonic sensor affixed to the rear side thereof and adapted to sense acoustical energy transmitted to the faceplate. The faceplate has no apertures through which acoustical energy is intended to be communicated to the transducer. All acoustical energy is mechanically coupled to the transducer. The plate is further adapted to be affixed to a wall or wall receptacle in a manner similar to that of a standard electrical switchplate or plug socketplate. The transducer and associated electronic components are adapted to be electrically connected to a remote annunciator in a conventional manner.

An important advantage of the present invention is that it allows acoustical communication between transmitter and receiving transducer, yet provides complete isolation of the transducer from hostile contact of a type expected in an incarceration facility.

Another advantage of the present invention is that it includes a faceplate which has no apertures through which damaging implements or liquids can be forced to damage or interfere with operation of the transducer.

Yet another advantage of the present invention is that it provides a highly secure, relatively inexpensive ultrasonic receiver apparatus for use in a hostile environment.

These and other objects and advantages of the present invention will no doubt become apparent to those skilled in the art after having read the following detailed description of a preferred embodiment illustrated in the several figures of the drawing.

IN THE DRAWING

DETAILED DESCRIPTION OF THE PREFERRED EMBODIMENT

Figure 1:
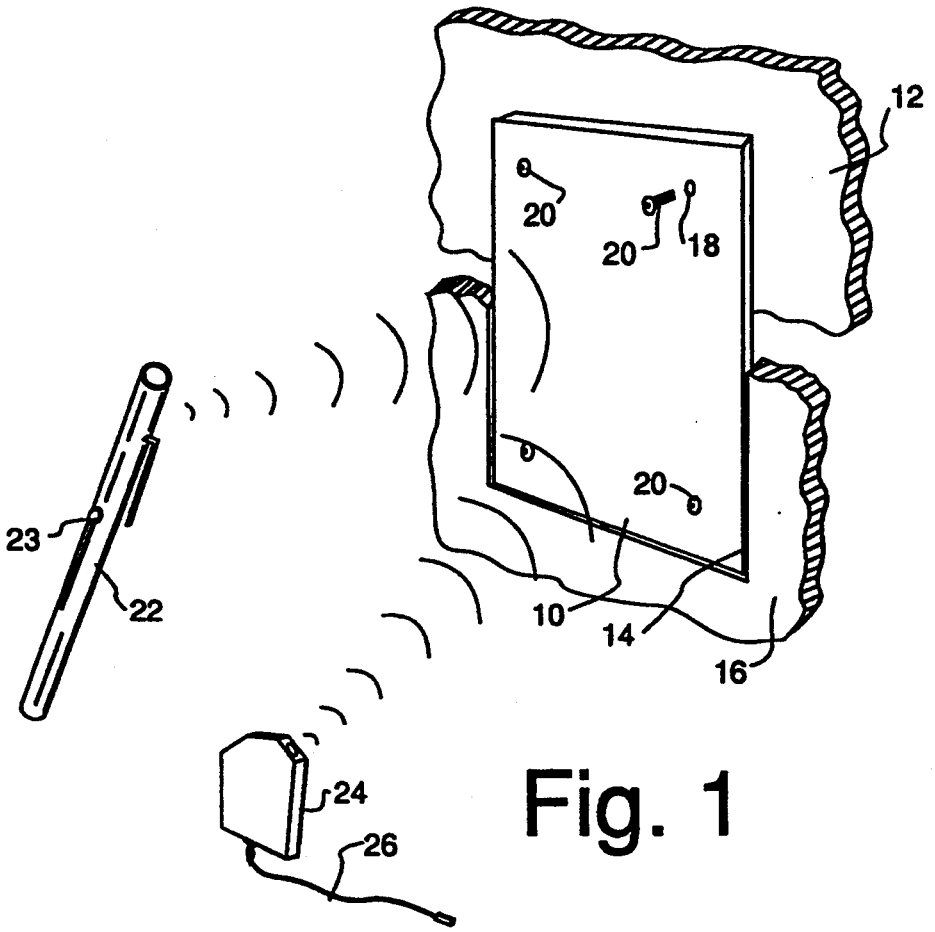
FIG. 1 is a partially broken perspective view illustrating typical faceplate mountings and signal sources of a high security ultrasonic receiver apparatus in accordance with the present invention.

Referring now to FIG. 1 of the drawing, the outer faceplate 10 of a high security ultrasonic receiver apparatus in accordance with the present invention is alternatively shown in broken section as being mounted to the outer face of a wall 12, and recessed within a mating receptacle 14 formed in a wall 16.

The faceplate 10 in the preferred embodiment is comprised of a 1/8" thick rigid metal plate, the front surface of which is plane with the exception of four holes 18 through which tamper-proof fastening screws or bolts 20 are extended. In the preferred embodiment the plate 10 was in one instance made of 5052 aluminum alloy, and in another embodiment was made out of 7075 aluminum alloy. The screws 20 pass through the openings 18 to secure plate 10 to an electrical box (not shown) mounted in the wall in much the same manner as is a standard electrical switchbox or receptacle box.

Also depicted in FIG. 1 is a pen-type ultrasonic transmitter 22 and a clothing-attached transmitter 24. The pen 22 might, for example, be of a mechanically actuated ultrasonic signal generator such as the model P105 transmitter pen manufactured by Sentry Products, Inc. of Santa Clara, Calif. This device includes an ultrasound generator actuated by retraction and release of a button 23 associated with an internal spring-loaded actuator (not shown).

The unit 24, as depicted, is the model LC210 electronic transmitter of the type worn on the clothing of a person to be protected. The illustrated transmitter 24 includes a strap 26 which, when separated from the transmitter 24, causes an ultrasonic signal to be electronically generated for transmission to the apparatus 10. The LC210 also includes a "man-down" feature which automatically signals for help in the event that it is caused to assume an unusual attitude.

Figure 2:
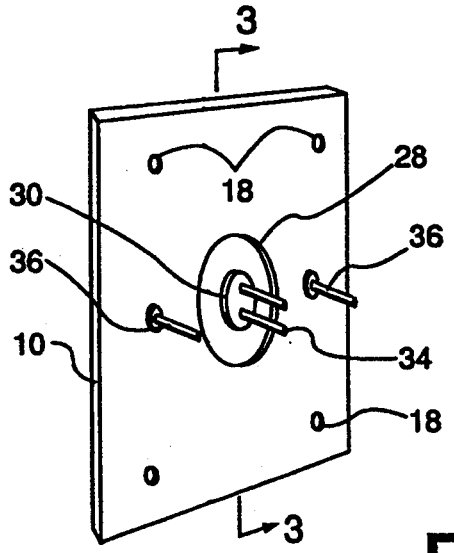
FIG. 2 is a perspective view illustrating the rear side of a portion of the receiver apparatus depicted in FIG. 1.

Turning now to FIG. 2 of the drawing, the rear side of plate 10 is shown to include a recess 28 having affixed to the center thereof an ultrasonic transducer 30 with electrical leads 32 and 34 extending therefrom. Also shown extending rearwardly of the plate 10 are two standoffs 36 which, as will be explained below, provide means for mounting other electrical components to the plate 10.

Figure 3:
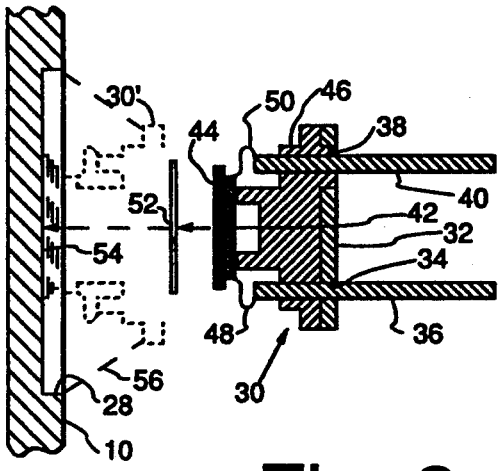
FIG. 3 is an exploded partial cross-section taken along the line 2—2 of FIG. 2.

In FIG. 3 of the drawing, a partial cross-section taken along the line 3—3 of FIG. 2 is illustrated depicting the transducer 30 exploded away from its mounting to plate 10.

As shown, the transducer assembly 30 includes a nickel-plated steel rearplate 32 having an aperture 34 through which a first nickel-plated brass lead 36 extends, and a second aperture 38 through which a second nickel-plated brass lead 40 extends. Note that whereas the diameter of aperture 34 is just large enough to receive lead 36, and lead 36 is mechanically and electrically connected thereto by soldering, the diameter of aperture 38 is large enough to allow lead 40 to pass therethrough without contact.

Disposed in spaced-apart relation to plate 32 is a piezo-electric crystal 42 and its associated nickel-plated brass base 44. Crystal 42 is held in spaced-apart position relative to plate 32 by a non-conductive plastic spacer 46, and is secured thereto with a silicon adhesive. Note that base 44 is electrically connected to lead 36 by a thin conductive wire 48, and crystal 42 is electrically connected to lead 40 by a thin conductive wire 50.

The transducer assembly 30 is affixed to plate 10 by cementing it to one side of a mica insulator disk 52, the opposite side of which is cemented to the inside surface 54 of plate 10. In the preferred embodiment cyanoacrylate is the preferred means of cementing assembly 30 to faceplate 10, in the position illustrated in phantom at 30'.

In order to protect the delicate wires 48 and 50, after attachment to plate 10 the junction between the transducer assembly and plate 10 is potted with a silicone material 56 such as Dow Corning ® 1-2577 Conformal coating or Dow Corning ® 738 RTV sealant. The purpose of the recess 28 in the back side of plate 10 is to provide a reservoir for containing the potting material 56 and allowing it to build up to a thickness sufficient to encapsulate the crystal 42 and the wires 48 and 50.

Figure 4:
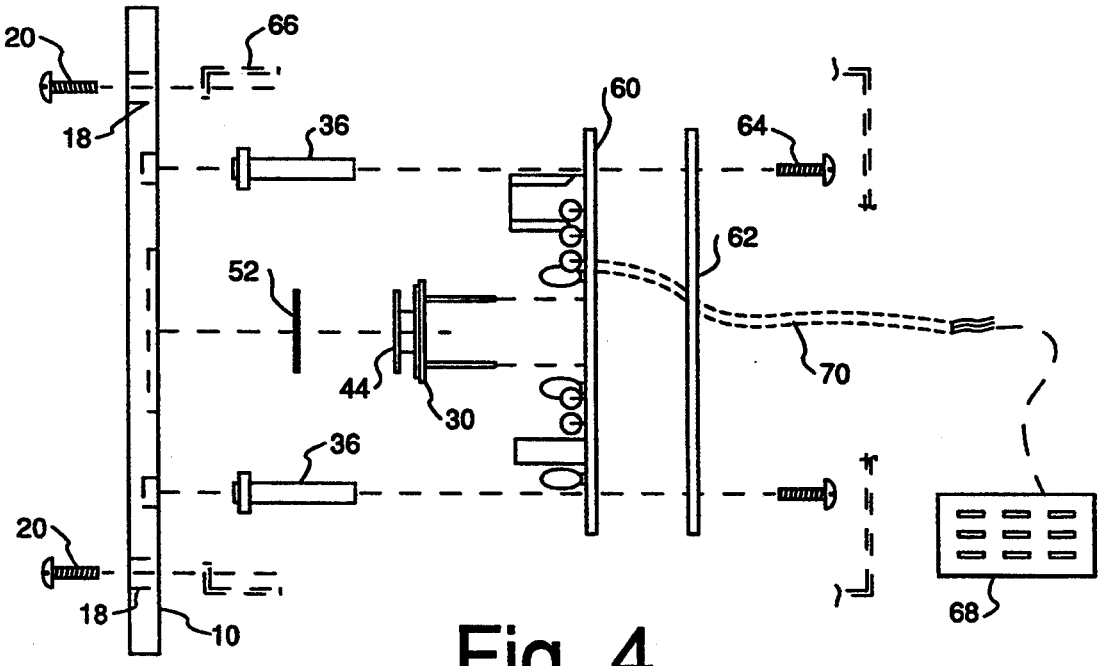
FIG. 4 is an exploded top view illustrating a complete receiver assembly in accordance with the present invention.

In FIG. 4 an exploded top view shows the entire receiver assembly including plate 10, transducer assembly 30, and standoffs 36 to which an electronic component-carrying circuit board 60 and insulator plate 62 are affixed by screws 64. The entire assembly is secured to a wall box schematically indicated by the dashed lines 66 by the screws 20 which pass through faceplate 10. Note that signals generated by the transducer and circuit board assembly are communicated to a remote annunciator panel 68 by suitable cabling 70.

In operation, ultrasound generated by transmitters such as those indicated in FIG. 1, and impinging upon plate 10 will cause minute distortions thereof sufficient to correspondingly distort the piezo-electric transducer in the assembly 30 and in turn cause a corresponding electrical signal to be generated which is pre-processed and amplified by electronic components carried by circuit board 60 (FIG. 4). The signal is then communicated to an annunciator panel 68 wherein an indication of the emergency is provided. Note that, since each receiver assembly is disposed in a predetermined location, the lighting of a particular indicator on panel 68 will provide an immediate indication of the room, cell or other location within a given facility where the corresponding emergency is occurring.

Although a particular preferred embodiment of the present invention has been illustrated and described above, it will be appreciated that various alternative configurations of components may be utilized. For example, the rectangular faceplate 10 might be configured in an oval, round, or other geometric shape. Fastening means other than the screws 20 may also be utilized. In addition, materials other than aluminum might be used to form faceplate 10; for example, a ceramic tile might be used. An important feature is that the faceplate be mechanically sturdy and able to withstand substantial abuse without sustaining material deformation. Another important feature of the present invention is that the received ultrasonic energy be mechanically conducted through the faceplate to the transducer assembly, and that no unclosed apertures or openings therein be included which might provide passageways for implements or liquids to pass and cause damage to the signal-generating components or interfere with their operation. It is therefore intended that the appended claims be interpreted as covering all such alterations and modifications as fall within the true spirit and scope of the invention.

We claim:

1. An ultrasonic receiver apparatus for mounting within a receptacle formed in a wall comprising:

an ultrasonic energy-responsive transducer and associated electronic components for generating electrical signals commensurate with ultrasonic energy detected by said transducer; and a faceplate formed of a relatively rigid material serving as a closure for said receptacle, the inside surface of said faceplate being provided with a recess for receiving a portion of said transducer and for containing a potting material surrounding a portion of said transducer, said transducer being fixedly secured to the inside face of said faceplate, said faceplate having no unclosed apertures such that ultrasonic energy directed upon the outside surface of said plate and detected by said transducer must be mechanically conducted through the material of said faceplate.

2. An ultrasonic receiver apparatus for mounting within a receptacle formed in a wall as recited in claim 1 wherein said transducer is a piezo-electric crystal device having its energy-receiving face secured to the inside surface of said faceplate and is operative to respond to mechanical distortions thereof.

3. An ultrasonic receiver apparatus for mounting within a receptacle formed in a wall as recited in claim 1 wherein said faceplate is fabricated of a metallic material having a thickness of approximately 1/8".

4. An ultrasonic receiver apparatus for mounting within a receptacle formed in a wall as recited in claim 1 wherein said transducer is electrically isolated from said faceplate by means of a layer of electrically insulative material.

5. An ultrasonic receiver apparatus for mounting within a receptacle formed in a wall as recited in claim 4 wherein said layer of electrically insulative material is in the form of a mica disk, the diameter of which is at least as large as the corresponding dimension of the normal energy receiving face of said transducer.

6. An ultrasonic receiver apparatus for mounting within a receptacle formed in a wall as recited in claim 5 wherein said transducer is secured to said mica disk with cyanoacrylate cement.

7. An ultrasonic receiver apparatus for mounting within a receptacle formed in a wall as recited in claim 6 wherein said mica disk is secured to the inside wall of said plate with cyanoacrylate cement.

8. An ultrasonic receiver apparatus for mounting within a receptacle formed in a wall as recited in claim 2 wherein said transducer is electrically isolated from said faceplate by means of a layer of electrically insulative material.

9. An ultrasonic receiver apparatus for mounting within a receptacle formed in a wall as recited in claim 8 wherein said faceplate is fabricated of a metallic material having a thickness of approximately 1/8".

10. An ultrasonic receiver assembly for disposition in a wall-mounted receptacle comprising:

a closure for said receptacle including a rigid faceplate having no unclosed passageways formed therein, the inside surface of said faceplate being provided with a recess for receiving a portion of a transducer and for containing a potting material surrounding a portion of the transducer;

a transducer positioned with said recess, affixed to the inside surface of said faceplate, operative to respond to ultrasonic energy mechanically conducted through said faceplate, and operative to generate a corresponding electrical signal; and means for communicating said electrical signal to an annunciator device.

11. An ultrasonic receiver assembly for disposition in a wall-mounted receptacle as recited in claim 10 wherein said transducer is a piezo-electric crystal device having its mechanical energy-receiving face rigidly affixed to said inside surface.

12. An ultrasonic receiver assembly for disposition in a wall-mounted receptacle as claimed in claim 11 wherein said closure member is formed of an aluminum plate having a thickness of at least 1/8".

13. An ultrasonic receiver assembly for disposition in a wall-mounted receptacle as claimed in claim 11 wherein said transducer is electrically isolated from said faceplate by means of a layer of electrically insulative material.

14. An ultrasonic receiver assembly for disposition in a wall-mounted receptacle as claimed in claim 12 wherein said layer of electrically insulative material is in the form of a mica disk, the diameter of which is at least as large as the corresponding dimension of the energy receiving face of said transducer.

15. An ultrasonic receiver assembly for disposition in a wall-mounted receptacle as claimed in claim 14 wherein said transducer is secured to said mica disk with cyanoacrylate cement.

16. An ultrasonic receiver assembly for disposition in a wall-mounted receptacle as claimed in claim 15 wherein said mica disk is secured to the inside wall of said plate with cyanoacrylate cement.

* * * * *